US006807923B1

(12) United States Patent
Wolfe et al.

(10) Patent No.: US 6,807,923 B1
(45) Date of Patent: Oct. 26, 2004

(54) AUDIBLE WARNING SIGNAL FOR ROADWAY WORK ZONES

(76) Inventors: James P. Wolfe, 396 Church St., Yalesville, CT (US) 06492; Eugene R. Wolfe, 396 Church St., Yalesville, CT (US) 06492; Ryan J. Wolfe, 396 Church St., Yalesville, CT (US) 06492

( * ) Notice: Subject to any disclaimer, the term of this patent is extended or adjusted under 35 U.S.C. 154(b) by 401 days.

(21) Appl. No.: 09/419,579

(22) Filed: Oct. 18, 1999

(51) Int. Cl.[7] ..... E01F 9/04; G08G 1/01
(52) U.S. Cl. ..... 116/63 R; 116/63 P
(58) Field of Search ..... 116/63 R, 63 K, 116/137 R, 139, 142 R, 142 FP, 142 FV, 173, 174, 175

(56) References Cited

U.S. PATENT DOCUMENTS 4,265,194 A * 5/1981 Sullivan ..... 116/106
5,265,556 A * 11/1993 Hall ..... 116/142 FP
5,422,638 A * 6/1995 Singer et al. ..... 116/63 P
5,474,016 A * 12/1995 Haney ..... 116/63 R
5,892,461 A * 4/1999 Dokko ..... 340/907
6,003,257 A * 12/1999 Stokes ..... 116/63 P
6,035,567 A * 3/2000 Cameron ..... 116/63 P
6,107,941 A * 8/2000 Jones ..... 116/63 R

* cited by examiner

*Primary Examiner*—Diego Gutierrez
*Assistant Examiner*—Yaritza Guadalupe
(74) *Attorney, Agent, or Firm*—John H. Crozier

(57) ABSTRACT

In a preferred embodiment, an audible warning device for use with a visual warning sign, comprising: a first segment to comprise part of a staff to which a visible warning portion is attached; and selectively activatable audible warning means disposed integrally with the first segment.

7 Claims, 5 Drawing Sheets

AUDIBLE WARNING SIGNAL FOR ROADWAY WORK ZONES

BACKGROUND OF THE INVENTION

1. Field of the Invention

The present invention relates to warning devices generally and, more particularly, but not by way of limitation, to a novel audible warning signal for roadway work zones.

2. Background Art

Work zones along or adjacent to roadways present a safety hazard to workers in such zones, due to traffic that may or may not proceed at slow speed when traversing the work zone. To provide some measure of safety, typically two persons are stationed with signs, the persons at opposite ends of the work zone and the signs having one side on which is printed "STOP" and the opposite side on which is printed "SLOW". The two persons coordinate their activities such that one person displays the "STOP" side to one line of traffic, while the other person displays the "SLOW" side to the other line of traffic while that line of traffic proceeds slowly through the work zone. The two persons may coordinate their activities through the use of hand signals or by two-way radios.

Unfortunately, there have been many instances in which a driver either ignores the signs or is inattentive and fails to see the signs or sees the sign(s) too late to slow the speed of the vehicle sufficiently. This presents a danger to the persons holding the signs, to the workpersons in the work zone, and also to the driver. This is especially serious, since the vehicle may be traveling at a speed of 70 miles per hour or more.

In many cases, the drivers fail to slow the speeds of their vehicle sufficiently to permit travel through or past the work zone. In such cases, there is little the persons holding the signs can do to warn the workpersons, since the warnings presented by the signs are visual and are directed only to the drivers of the vehicles.

Accordingly, it is a principal object of the present invention to provide means to furnish an audible warning signal for a roadway work zone.

It is a further object of the invention to provide such an audible signal that warns not only drivers of vehicles, but also workpersons in the work zone.

It is an additional object of the invention to provide such an audible signal that can be easily operated by the hand of a person holding a warning sign.

It is another object of the invention to provide such an audible signal that is economically implemented.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an audible warning device for use with a visual warning sign, comprising: a first segment to comprise part of a staff to which a visible warning portion is attached; and selectively activatable audible warning means disposed integrally with said first segment.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
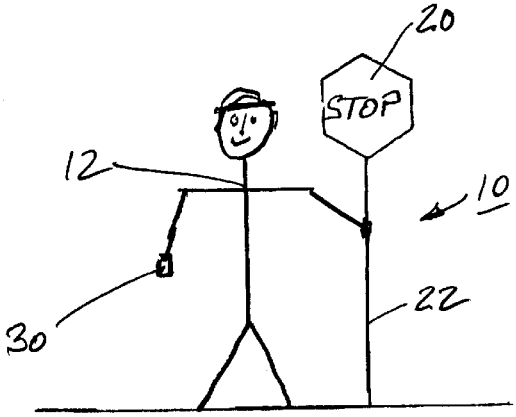
FIG. 1 (PRIOR ART)
FIG. 1 is a front elevational view of a person holding a warning sign of the type used in warning vehicles at a roadway work zone.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a warning sign, generally indicated by the reference numeral 10, and being held by a person 12. It may be assumed that sign 10 and person 12 are positioned at a work zone on or adjacent a roadway to advise vehicles to stop or to proceed slowly.

Sign 10 includes a display portion 20 and a staff portion 22. As shown on FIG. 1, the front of display portion 20 indicates "STOP", meaning that vehicles approaching the work zone are to stop. Person 12 may also be holding a two-way radio 30 to communicate with a similar person (not shown) at the other end of the work zone, so that the two persons can coordinate their activities.

Figure 2:
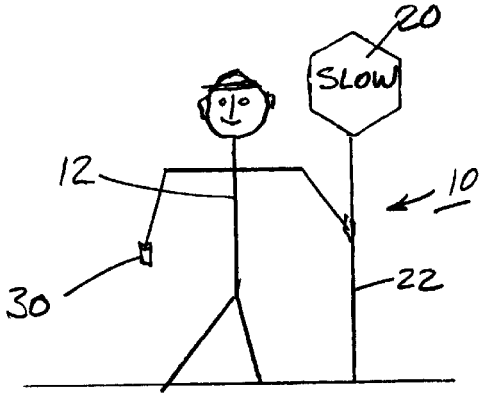
FIG. 2 (PRIOR ART)
FIG. 2 is a front elevational view of the person of FIG. 1 holding the warning sign rotated 180 degrees to show the back of the sign.

FIG. 2 illustrates person 12 having rotated sign 10 180 degrees, so that the reverse side of display portion indicating "SLOW" is visible, meaning that vehicles are to proceed through the work zone slowly.

It will be understood that, when person 12 (FIG. 1) displays the "STOP" side of display portion 20, the sign held by the other person at the other end of the work zone will be displaying "SLOW". When a desired number of vehicles has passed the other person, the other person will rotate the other sign to indicate "STOP" and then, after all vehicles have cleared the work zone and suitable communication over two-radio 30 has taken place, person 12 will rotate sign 10 so that "SLOW" is indicated on the display portion, meaning that vehicles are to proceed past person 12 and through the work zone at a slow speed.)

As noted above, often there have been many instances where a driver either ignores the signs or is inattentive and fails to see the signs or sees the sign(s) too late to slow the speed of the vehicle sufficiently. This presents a danger to the persons holding the signs, to the workpersons in the work zone, and also to the driver. This is especially serious, since the vehicle may be traveling at a speed of 70 miles per hour or more. The present invention helps overcome this situation by providing a segment, or manually graspable portion, of staff 22 (FIG. 1) containing an audible warning device that can be activated by person 12.

Figure 3:
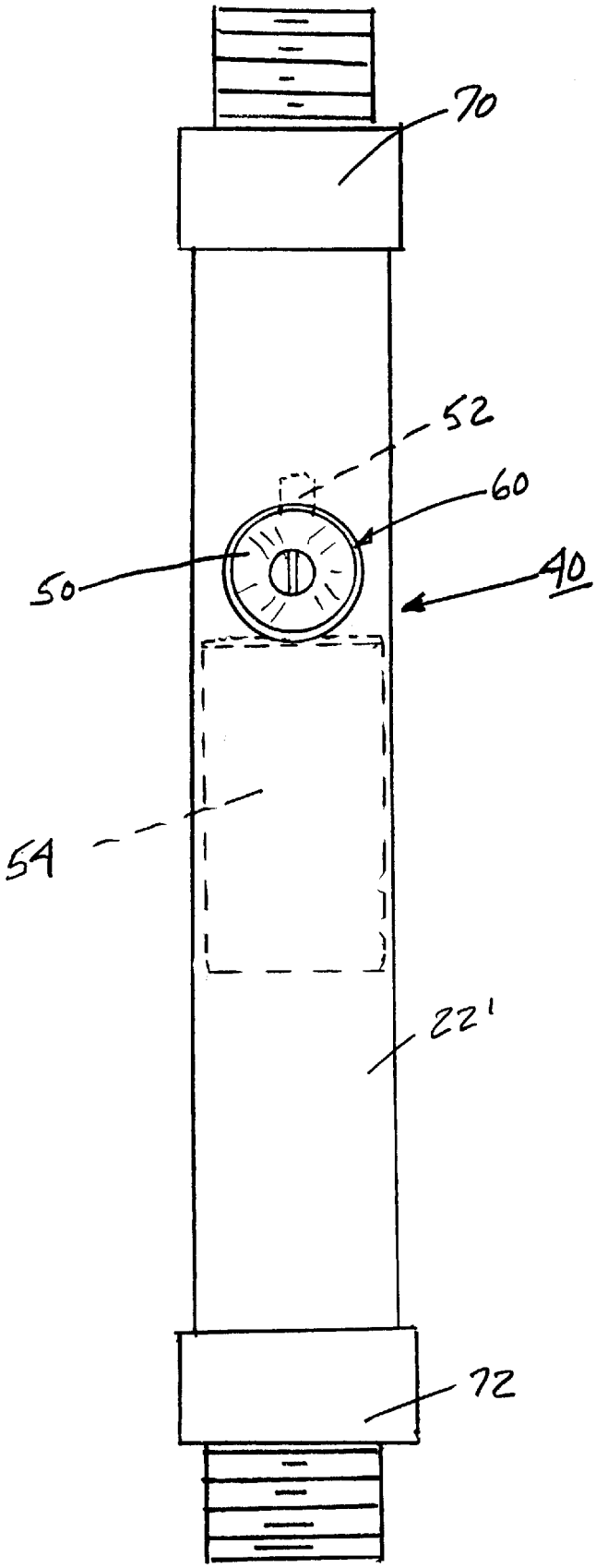
FIG. 3 is a front elevational view of an audible warning signal device according to the present invention.

FIG. 3 illustrates the present invention which includes a segment 22' of staff 22 (FIG. 1) that has integrally mounted thereto a compressed gas signalling device, generally indicated by the reference numeral 40. Compressed gas signalling device 40 includes a flared horn portion 50 and a activation button 52, the compressed gas signalling device being mounted on a compressed gas canister 54. Compressed gas signally device 40 and compressed gas canister 54 may be, for example, the SAFE&SOUND Signal Horn as furnished by Tempo Products Company, of Solon, Ohio.

In the embodiment shown on FIG. 3, compressed gas signalling device 40 and compressed gas canister 54 are mounted interiorly of segment 22', with flared horn portion 50 disposed in an opening 60 defined in the segment. Segment 22' may be cut from standard two-inch-diameter PVC pipe, with threaded end caps 70 and 72 disposed at the upper and lower ends of the segment to permit the segment to be conveniently attached to couplings disposed at ends of other segments of staff 22 (FIG. 1), the total length of the segments providing the desired height of display portion 20.

Figure 4:
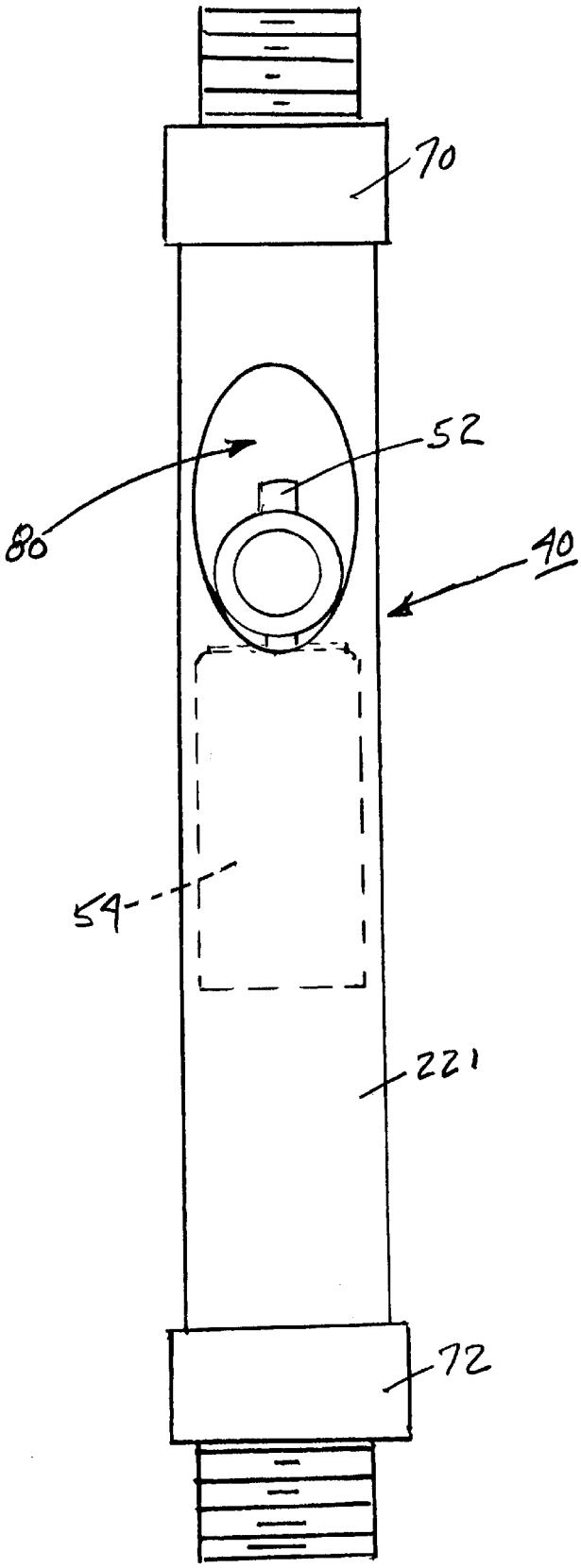
FIG. 4 is a rear elevational view of the audible warning signal device.

FIG. 4 illustrates segment 22', with compressed gas signalling device 40 and canister 54 disposed therein, and shows that activation button 52 is accessible through an opening 80 defined in the segment.

Figure 5:
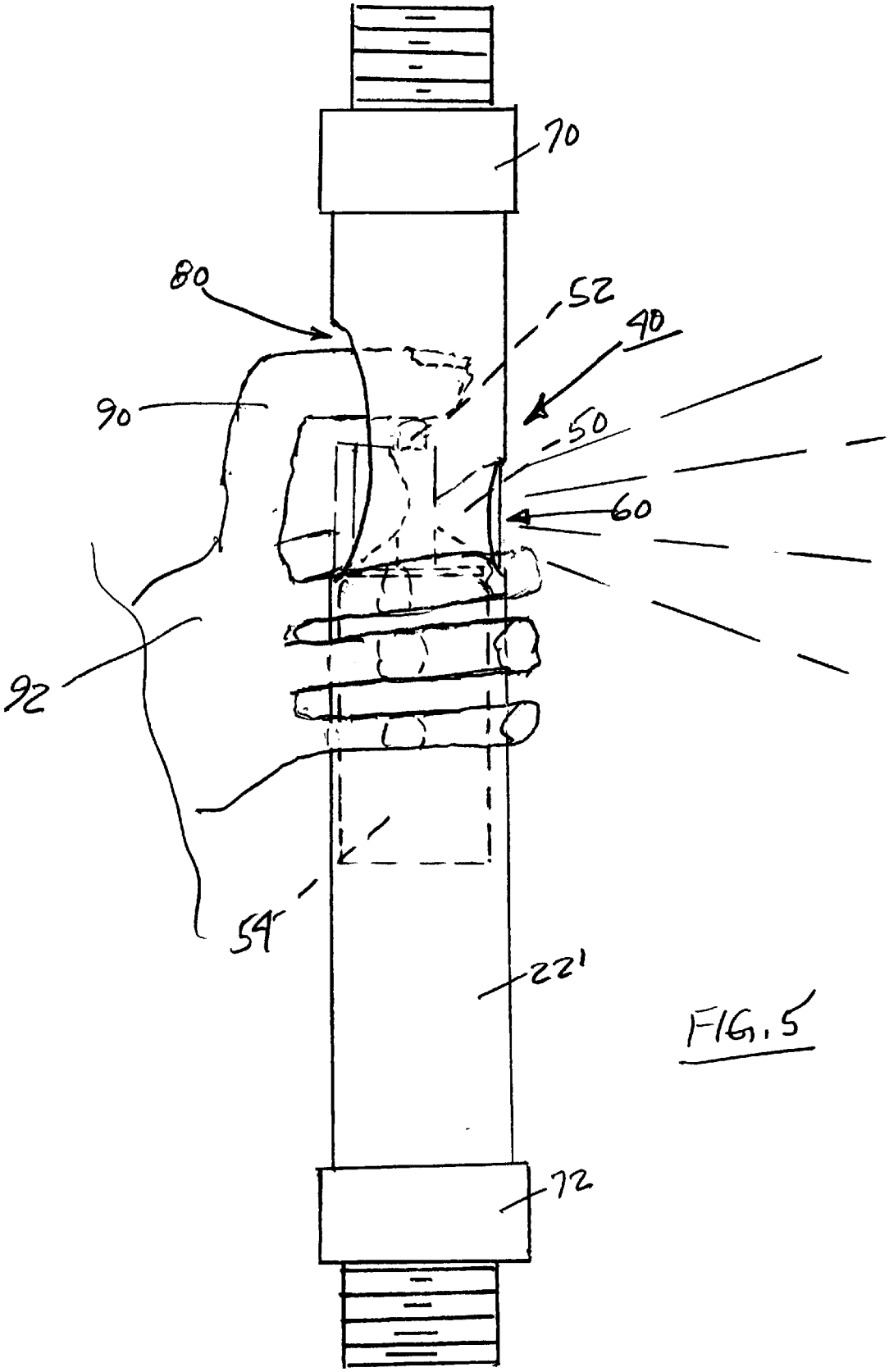
FIG. 5 is a fragmentary side elevational view of the audible warning signal device in use.

FIG. 5 illustrates the present invention in use. Here, an index finger 90 of the hand 92 of a person holding segment 22', and therefore staff 22 (FIG. 1) of sign 10, is inserted through opening 80 to depress activation button 52, thus causing a loud sound to be emitted through opening 60. The sound can be used to alert a driver of a vehicle to pay attention to the visual signs and, importantly, the sound also alerts workers in the work zone to the fact that they are potentially in danger and to take necessary precautions.

Figure 6:
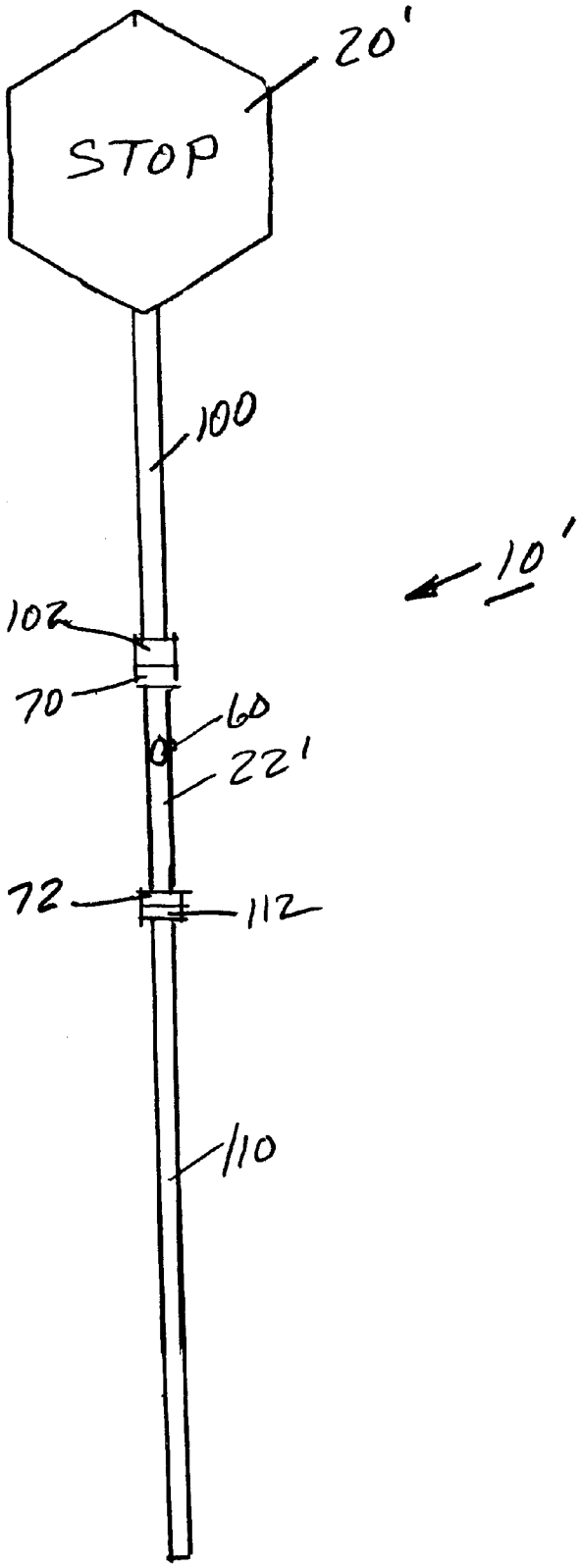
FIG. 6 is a front elevational view of a warning sign employing the present invention.

FIG. 6 illustrates segment 22' mounted in a warning sign, generally indicated by the reference numeral 10'. The staff of sign 10', which may be two-inch-diameter PVC pipe, includes an upper portion 100 having mounted at the lower end thereof a coupling 102 into which upper end cap 70 is threadingly inserted. The staff of sign 10' also includes a lower portion 110 having mounted at the upper end thereof a coupling into which lower end cap 72 is threadingly inserted. Upper and lower end caps 70 and 72 may be frictionally held to the ends of segment 22'. The total length of sign 10' is conventionally about eight feet.

While any suitable means can be provided for mounting compressed gas signalling device 40 in, or to the outside of, segment 22', it has been found that, with the use of the above compressed gas signalling device in a two-inch-diameter PVC pipe, the compressed gas signalling device is supported loosely in the PVC pipe by engagement of the housing of the compressed gas signalling device with the edges of opening 80 and the engagement of flared horn portion 50 with the edges of opening 60. Compressed gas canister 54 can be easily installed or replaced by removing frictionally mounted lower end cap 72 and reaching into the lower end of segment 22' to unscrew or install the canister. Compressed gas signalling device 40 can be removed through opening 80, once compressed gas canister 54 has been unscrewed from the compressed gas signalling device.

As suggested above, the audible signalling device can be mounted to the outside of the sign staff. However, it is desirable that the audible signalling device be activatable by the hand of the person holding the sign staff. This will permit the person to quickly activate the audible signalling device. Such an arrangement is especially important in those situations in which the person is holding a two-way radio in the person's other hand.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A warning sign, comprising;

(a) a manually rotatable, vertical staff having a manually graspable portion:

(b) a display portion mounted on said staff to impart visual warning information to an observer;

(c) a compressed gas signaling device disposed within said manually graspable portion; and (d) said compressed gas signaling device includes activation means manually accessible through a first opening defined in said manually graspable portion.

2. A warning sign, as defined in claim 1, wherein: said compressed gas signaling device includes a flared horn portion adjacent a second opening defined in said manually graspable portion.

3. A warning sign, as defined in claim 1, wherein: said compressed gas signaling device is disposed within a first vertical segment of said staff intermediate second and third vertical segments of said staff.

4. A warning sign, comprising;

(a) a manually rotatable, vertical staff having a manually graspable, vertical portion:

(b) a display portion mounted on said staff to impart visual warning information to an observer; and (c) manually selectively activatable audible warning means disposed adjacent said manually graspable, vertical portion, such that said manually selectively activatable, manual audible warning means can be activated by a person holding said manually graspable, vertical portion;

(d) said audible warning means comprises a compressed gas signaling device;

(e) said compressed gas signaling device is disposed within a first vertical segment of said staff;

(f) said compressed gas signaling device includes a flared horn portion adjacent a first opening defined in said first vertical segment; and (g) said compressed gas signaling device includes activation means manually accessible through a second opening defined in said first vertical segment.

5. A warning sign, as defined in claim 4, wherein: said first segment is disposed between second and third vertical segments of said staff.

6. An audible warning device for use with a visual warning sign, comprising:

(a) a first vertical segment to comprise part of a manually rotatable staff, said first vertical segment having a manually graspable, vertical portion, to which manually rotatable staff a visible warning portion is attached; and (b) selectively activatable audible warning means disposed adjacent said manually graspable, vertical portion, such that said manually selectively activatable, manual audible warning means can be activated by a person holding said manually graspable, vertical portion;

(c) said audible warning device comprises a compressed gas signaling device;

(d) said compressed gas signaling device is disposed within said fire vertical segment;

(e) said compressed gas signaling device includes a flared horn portion adjacent a first opening defined in said first vertical segment; and (f) said compressed gas signaling device includes activation means manually accessible through a second opening defined in said first vertical segment.

7. An audible warning device for use with a visual warning sign, as defined in claim 6, wherein: said first vertical segment has means attached to upper and lower ends thereof for attachment between second and third vertical segments of said staff.

* * * * *